US005251804A

United States Patent [19]

Nakamura

[11] Patent Number: 5,251,804

[45] Date of Patent: Oct. 12, 1993

[54] METHOD FOR THE CONTINUOUS MANUFACTURE OF METAL-PLATED STEEL TUBES BY MOLTEN PLATING TREATMENT

[75] Inventor: Matsuichi Nakamura, Ashiya, Japan

[73] Assignee: Daiwa Steel Tube Industries Co., Ltd., Osaka, Japan

[21] Appl. No.: 903,447

[22] Filed: Jun. 24, 1992

[51] Int. Cl.[5] ..... B23K 31/02

[52] U.S. Cl. ..... 228/147; 228/176; 228/203; 427/401

[58] Field of Search ..... 228/144, 146, 147, 176, 228/203, 17.5, 18; 29/33 D, 458, 460; 427/436, 401, 420, 349, 383.7

[56] References Cited

U.S. PATENT DOCUMENTS

| | | | |
|---|---|---|---|
| 2,927,371 | 3/1960 | Hays | 228/147 |
| 4,191,319 | 3/1980 | Headrick et al. | 228/147 |
| 5,035,042 | 7/1991 | Maitra et al. | 29/458 |
| 5,113,557 | 5/1992 | Maitra et al. | 29/33 D |

FOREIGN PATENT DOCUMENTS

| | | | |
|---|---|---|---|
| 632510 | 11/1978 | U.S.S.R. | 228/147 |

*Primary Examiner*—Samuel M. Heinrich
*Attorney, Agent, or Firm*—Hopkins & Thomas

[57] ABSTRACT

Steel strip (1) is cleaned by shot blast machine (3) and its upper surface is coated with zinc in molten plating device (4). The strip is formed by roll forming machine (6) into a tube and the outer surface of the tube is coated by plating device (11).

7 Claims, 3 Drawing Sheets

METHOD FOR THE CONTINUOUS MANUFACTURE OF METAL-PLATED STEEL TUBES BY MOLTEN PLATING TREATMENT

FIELD OF THE INVENTION

This invention relates to a method of manufacturing metal-plated steel tubes where both the inner and the outer surfaces of the tubes, or a single surface only, i.e., either the inner or the outer surface, are treated by molten metal-plating in a continuous steel tube manufacturing line.

BACKGROUND OF THE INVENTION

Regarding conventional molten metal plating methods for steel tubes, a typical example thereof is hot dip plating. For instance, in the zinc hot dip galvanizing method, where both inner and outer surfaces of a steel tube are galvanized by dipping said steel tube in a molten zinc bath as presented in Japanese patent application No. 116864/81, the steel tube is tilted 40 degrees or more to the horizontal immediately after being removed from the molten zinc bath in order to remove the surplus zinc adhering to the steel tube inner surface. Next, the surface is quickly heated above the melting point of zinc, and the surplus zinc adhering to the outer surface of the steel tube is removed by blowing compressed gas against the surface of the tube which bears the molten zinc.

To meet changing industrial requirements, steel manufacturers began making surface-treated steel sheet by plating cold and hot rolled steel sheet. This resulted in plated steel tubes being manufactured from surface-treated steel strip.

Because the steel tube made from this plated steel sheet ("steel sheet" hereinafter includes "steel strip") is welded after undergoing plating, plating on the weld surface peels off and it can then be repaired. However, problems associated with rust occurrence and rust preventive capability in galvanizing occur with this method.

Steel tubes with a metal-plated outer surface and a coated inner surface are used from a cost viewpoint, and represent one method of manufacturing molten metal plated steel tubes in a continuous manufacturing line.

One manufacturing process of this method of manufacturing molten metal plated steel tubes already developed by this inventor is disclosed in U.S. Pat. No. 3,927,816. That invention shows a series of process steps for manufacturing steel tubes with a molten metal plated outer surface, where steel strip is cold-formed into tubular form, welded, and finally given a continuous molten metal plating treatment.

On the other hand, in recent years, with the expansion of industrial applications and increased severity of environmental conditions, good corrosion resistance of the inner surfaces of steel tubes has become necessary along with increased requirements for metal plating of the inner surfaces. Under these circumstances, a technique that permits continuous metal plating of both the inner and outer surfaces of steel tubes formed from steel plate has not yet been perfected.

One current technique which can be cited is single-surface plating of steel sheets. Regarding this single-surface molten metal plating technique which is applicable for steel sheets and steel strip, the following typical methods are known. The first is the application of certain chemicals on one side of the sheet to prevent a reaction between the steel sheet and the molten metal, followed by immersion of the steel plate in a plating bath where a single surface is plated. The second is the application of plating on both surfaces and the removal of the plating layer on one surface mechanically or chemically. Zinc-plating of a single surface by roll coater constitutes the third method. However, these methods all aim at single-surface molten metal plating for steel sheet and steel strip.

Japanese patent application No. 116884/81 presents a conventional method of applying zinc plating to both inner and outer surfaces of steel tubes by dipping them in a molten zinc bath. However, this method is applicable for hot dip galvanizing of manufactured steel tubes cut to a certain length and has the problem of not being applicable to double-surface molten metal plating in a continuous production line where steel strip is cold-formed into tubular form, welded, then treated by molten metal plating.

U.S. Pat. No. 3,927,816 teaches that the desired effect can be obtained on the exterior of the steel tube, however, that patent does not teach molten metal plating of the inner surface of the tubular steel.

On the other hand, single-surface molten metal plating for steel sheet is not always applicable in a continuous steel tube production line, and involves numerous manufacturing problems.

SUMMARY OF THE INVENTION

Briefly d the present invention comprises the production, in a continuous manufacturing line, of double-surface molten metal plating of steel tubes, i.e., both inner and outer surfaces of the tube are plated. In this method, plating is applied to the single surface of the steel strip in a steel tube production line, which corresponds to the inner surface of the steel tube. The steel strip is then cold-formed into tubular shape and its longitudinal edges are welded together, then finally the outer surface of the steel tube is molten metal plated.

More specifically, the production process is performed in a continuous production line in which the steel sheet is advanced along its length, comprising the following steps: pretreating the single surface of a steel sheet which corresponds to the inner surface of a steel tube to remove oxide and other undesirable surface materials, plating this single surface by the application of molten metal by pouring molten metal onto the inner surface, cold-forming the steel sheet into tubular shape, seam-welding the longitudinal edges of the sheet together to shape a joint to make a complete steel tube, removing the oxide film from the exterior surface of the tube, dipping the outer surface of said steel tube in a molten metal plating bath, cooling the plated steel tube, and finally, cutting it to a specified length.

In the above described manufacturing process in which the steel tubes are continuously treated by molten metal plating on both inside and outside surfaces, the steps of plating both surfaces can be limited to plating a single surface only, namely, either the inner surface or the outer surface, in the same manufacturing line.

Therefore, it is an object of this invention to provide an improved process for the manufacturing of steel tubes with both inner and outer surfaces, or either one of the inner or outer surfaces, plated with molten metal in a continuous production line, which includes the step of cold forming of the steel strip into tubular shape and welding the longitudinal edges together.

Another object of the invention is to provide an improved steel tube having both inside and outside surfaces coated with zinc or the like, which has an improved appearance and resistance to corrosion.

Other objects, features and advantages will become apparent from reading the following description when taken in consideration with the attached drawings.

BRIEF DESCRIPTION OF THE DRAWINGS

This invention will be described in detail according to drawings as follows.

DETAILED DESCRIPTION

Figure 1:
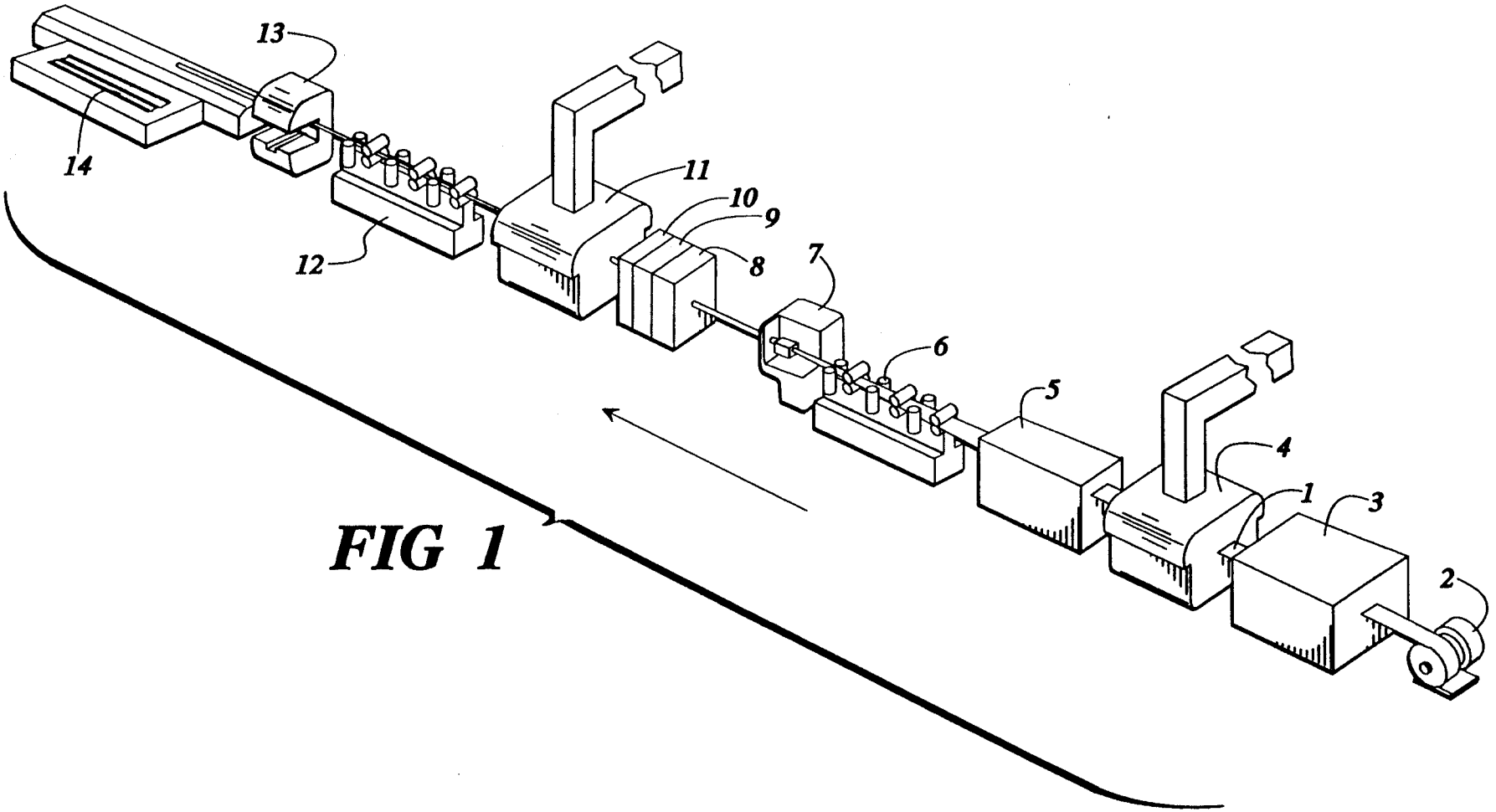
FIG. 1 is a flow diagram that shows the process of the continuous manufacturing line which is the embodiment of this invention.

Referring now in more detail to the drawings, in which like numerals refer to like parts in the several views, FIG. 1 shows steel sheet 1 which is fed out and advanced along its length from supply uncoiler 2 and then the upper surface which will become the inner surface of the steel tube undergoes pretreatment such as shot blasting in shot blast machine 3. After that, molten metal plating of the upper surface, for example molten zinc plating, is performed with pouring-type single-surface molten metal plating device 4, and the steel sheet with one plated surface is then cooled in cooling vessel 5.

Next, the steel sheet, now with one surface plated, is formed into tubular shape by roll forming machine 6. The edges of the steel sheet which are to form the joint of the tube are welded together by welding machine 7 that permits continuous welding in the longitudinal direction. Thus, steel tube is continuously produced.

From the manufactured steel tube, the iron powder and oxide film adhering to the surface of the steel tube at the roll forming or welding processes is removed by a pickling device 8 and the steel tube is then washed in washer 9 to remove pickling liquid. Anti-oxidant flux liquid is then applied in bath 10 to the surface of the steel tube.

After drying, molten metal plating is applied to the outer surface of the steel tube by molten metal plating device The surplus molten metal adhering to the surface of the steel tube is sprayed over the surface of the steel tube to a certain thickness using air or inert gas. After cooling, roll finish 12 is performed including sizing to set the section of the steel tube to a standard size by cold working and correction of steel tube bending. Subsequently, the steel tube is cut to a specified length by cutting device 13 to produce steel tube product 14 with both sides metal-plated.

Figure 2:
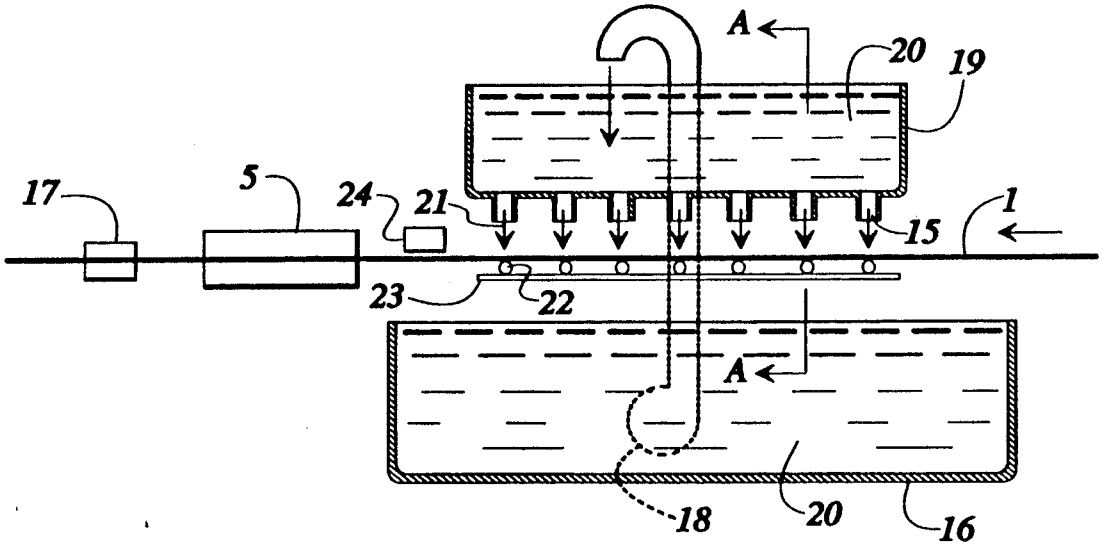
FIG. 2 is a schematic flow diagram of the single surface plating device.
Figure 4:
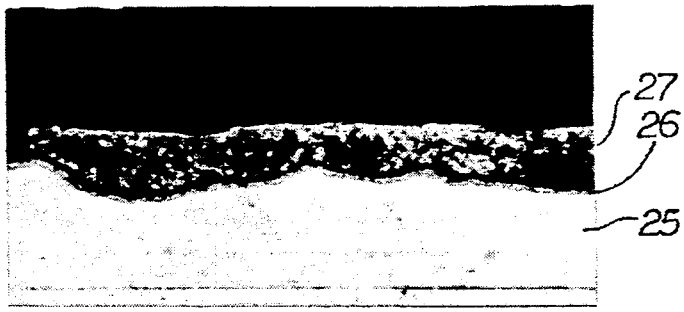
FIGS. 4–8 comprise photomicrographs of the product formed by the process, with these photomicrographs being magnified up to approximately 200 times.
Figure 5:
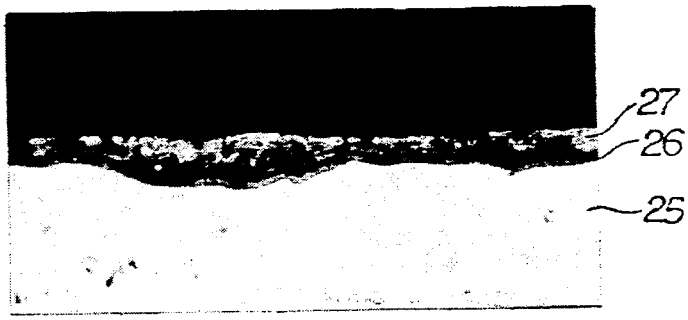
Figure 6:
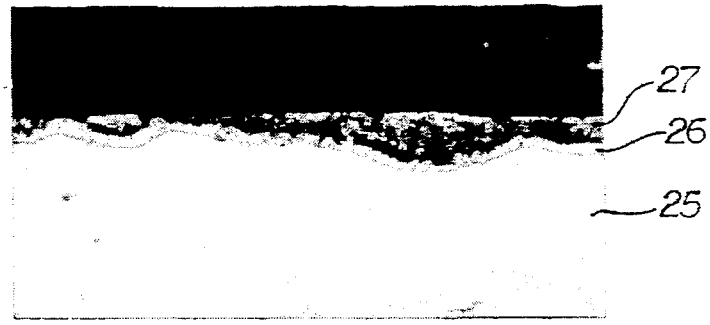
Figure 7:
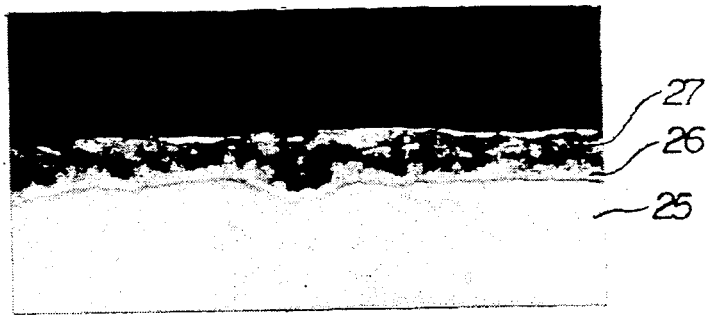
Figure 8:
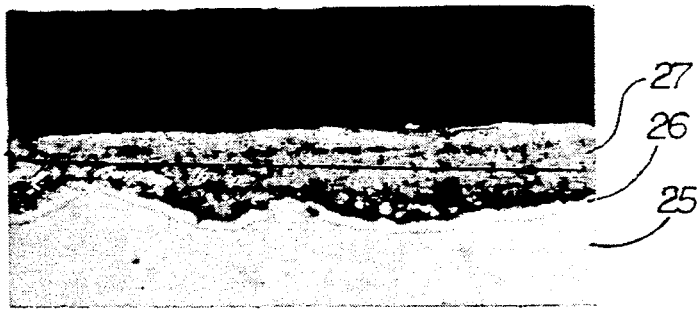

FIG. 2 is a schematic drawing of the single-surface plating device 4. The molten metal stored in a molten metal bath, for example, molten zinc in molten zinc plating bath 16, is heated by a burner (not shown) in order to maintain it in a molten state. This molten zinc is sucked up by pump 18 and supplied to upper trough 19 from where it is continuously supplied by pouring through a plurality of openings 15 in the bottom of the trough spaced along the length of the path of the steel sheet, onto the upper surface of pretreated steel sheet 1 that is continuously moving along its processing path. Downward deflection of steel sheet 1 due to the weight of the poured zinc is prevented by support rolls 22 or by a rub plate (not shown) which are located beneath the upper trough 19 and the path of the steel sheet 1 and which support the steel sheet. Pipes 23 are provided on both sides of the support rolls (or rub plate) 22 (FIG. 3) to prevent the molten zinc from spreading toward the opposite surface of steel sheet 1 by blowing compressed air or inert gas outward to both sides of support roll (or rub plate) 22.

After the first surface of the steel sheet is treated with molten zinc plating by molten zinc pouring, the amount of adhered plating is adjusted by air knife device 24, then the steel sheet is cooled in cooling vessel 5. Air knife device 24 provides compressed air to wipe off surplus molten metal to obtain a prescribed amount of molten metal on the steel sheet. Cooling vessel 5 comprises a series of nozzles for both sides of the steel sheet and a recirculation pump which sprays the steel sheet with sufficient volume of the water to remove the heat from the steel sheet at a certain passing rate. Recirculating water is maintained at ambient temperature. This process prevents the growth of excess alloy layer and to provide a shiny finish to the plated surface. Immediately after that, surplus metal plating adhering to both edges of steel sheet 1 is shaved off by scarfer 17.

Figure 3:
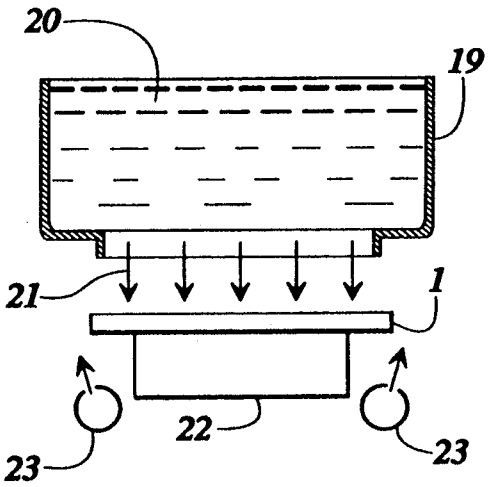
FIG. 3 is an end view, in cross section, taken along lines A—A', of FIG. 2, of the single surface plating device.

FIG. 3 is a cross sectional view taken along line A—A'—A' of FIG. 2 and indicates the pouring state from upper through 19 to steel sheet 1. Because molten zinc is poured, pipe 23 is provided to spray compressed air or inert gas outward to both sides of the support roll (or rub plate) 22 in order to prevent the molten zinc from reaching the rear surface of steel sheet 1 and to prevent plating of said rear surface.

As illustrated in FIG. 3, to prevent non-uniform plating due to deflection of the steel sheet caused by the weight of molten zinc 21 poured from upper trough 19 onto steel sheet 1, support rolls 22 support steel sheet 1 from beneath the steel sheet and along the length of the steel sheet as the steel sheet is advanced along its length beneath the trough 19 to prevent upper and lower deflection of the steel sheet. Thus, single-surface plating may be obtained to a uniform thickness width-wise of the steel sheet.

Examples of single-surface molten zinc plating are provided as follows:

From a hot rolled steel sheet with a thickness of 1.4 mm and a width of 75 mm, the iron powder and scales adhering to the surface of the steel sheet were removed by a shot blasting device and the oxide film produced on the surface of the steel sheet was removed by pickling. After that, the steel sheet was washed and anti-oxidant flux liquid was applied to only one surface of the steel sheet by a flux device. After drying, the steel sheet underwent a series of pretreatments for preheating at 280–293 degrees C. Then, molten zinc was poured onto the steel sheet at a temperature of 436–438 degrees C. by the pouring-type single-surface plating method as previously described herein. These results are shown as working example 1 in Table 1.

As a result, in working examples 1–4 using the method of this invention, 5–15 um of Zn-Fe alloy layer was obtained on the steel sheet as well as the plated steel sheet showing excellent adhesion, workability and appearance, without any adhesion of plating on the rear surface.

Comparative examples 5, 6, 7 and 8 of Table 1 provide actual results of ordinary products manufactured by the technique of the zinc hot dip method according to the invention of U.S. Pat. No. 3,927,816. However, the thickness of the Zn-Fe alloy layer in these examples is 5–16 um. This shows that the plating characteristics of this invention match the actual plating results seen on ordinary products.

The photomicrographs of FIGS. 4–8 illustrate the coatings applied to the steel, sheets, with photomicrographs corresponding respectively working examples 1–4 and 7 of the following table.

In each of FIGS. 4–8, the base metal (Fe) 25 is shown having a Zn-Fe alloy layer 26 and a Zn plated layer 27.

Note 1: The amount of adhered zinc indicates the range in which the air knife device was able to control the amount of zinc adhesion.

Note 2: Comparative examples 5, 6, 7 and 8 show the actual results of the zinc-plated steel tube manufactured by the zinc hot dipping method.

Note 3: The bending test results of the comparative examples were obtained by observing the plated surface after conducting a flattening test.

Note 4: Regarding the sections of the zinc plated layers obtained in working examples 1, 2, 3 and 4 in Table 1 and the section of the zinc plated layer of comparative example 7, the solid Zn-Fe alloy layer and zinc plated layer intruded onto the shot surface. This is recognized as one of the characteristic features of the invention of U.S. Pat. No. 3,927,816.

TABLE 1

| | WORKING EXAMPLE | | | | COMPARATIVE EXAMPLE | | | |
|---|---|---|---|---|---|---|---|---|
| ITEM | 1 | 2 | 3 | 4 | 5 | 6 | 7 | 8 |
| Steel plate passing rate (m/min) | 180 | 120 | 60 | 30 | 180 | 150 | 60 | 30 |
| Thickness of Zn—Fe alloy layer (μm) | 5 | 6 | 10 | 15 | 5 | 6 | 11 | 16 |
| Amount of adhered Zn | | | | | | | | |
| minimum ($g/m^2$) | 80 | 80 | 80 | 120 | 80 | 80 | 80 | 120 |
| maximum ($g/m^2$) | 770 | 720 | 720 | 720 | 500 | 450 | 450 | 450 |
| Bending test (180°/2tr) | Good | Good | Good | Good | Good | Good | Good | Good |
| Rear surface evaluation for plated surface | No Zn | No Zn | No Zn | No Zn | — | — | — | — |
| Appearance evaluation for plated surface | Good | Good | Good | Good | Good | Good | Good | Good |

As described above, the single-surface zinc plating performance obtained through this invention is characterized by a uniform and smaller-thickness Zn-Fe alloy layer and an easily-workable plated layer. In addition, a single-surface plated steel sheet of high corrosion resistance was obtained.

The steel tube with both plated inner and outer surfaces manufactured from this steel sheet in a continuous production line where the sheet is formed into steel tube and treated by molten zinc plating the outer surface, showed excellent corrosion resistance which in turn has a remarkable effect on productivity improvement and increased industrial applications such as for scaffolding, fences, poles, agricultural polyvinylchloride-coated steel tubes, conveyor tubes and rigid steel conduits.

While the invention has been described with molten zinc as the coating that is applied to the surfaces of the steel tube, other coating materials can be applied to the surfaces of the tube, as may be desired, and the invention as hereafter claimed should not necessarily be limited to a specific coating material.

Further, while a specific embodiment of the invention has been disclosed herein, variations and modifications thereof can be made without departing from the spirit and scope of the invention, as described in the following claims.

I claim:

1. A method of manufacture of steel tubes from steel sheet having opposed surfaces which form inner and outer surface of the tubes, wherein both inner and outer surfaces of the steel tubes are treated by molten metal plating in a continuous manufacturing line, comprising the following steps: pretreating a single surface of a steel tube, plating this single surface by the application of molten metal by pouring, cold forming the steel sheet into tubular shape, seam-welding the joint in this tubular steel sheet to make a complete steel tube, dipping the outer surface of the steel tube in a molten metal plating bath after a pretreatment process, continuously cooling the plated steel tube, and finally, cutting the steel tube to a specified length.

2. A method of manufacturing metal-plated steel tubes with both inner and outer surfaces continuously treated by double-surface molten-metal plating in a manufacturing line comprising the following processes: pretreating a single surface of a steel sheet which corresponds to the inner surface of a steel tube, plating this single surface by pouring molten metal, cold-forming the steel sheet into tubular form, seam-welding the joint in the tubular steel to complete the formation of the tubular shape, dipping the outer surface of the tube in a molten metal plating bath after a pretreatment process, continuously cooling the plated steel tube, and finally cutting the steel tube to a specified length.

3. In a method of manufacturing steel tubes from steel sheet with both the inner and outer surfaces of the steel tube coated with zinc, the improvement therein comprising:

advancing an elongated strip of steel sheet along its length through a processing path;

as the steel sheet is advanced, performing the following described steps at intervals along the path;

cleaning at least the surface of the steel sheet that corresponds to the inside of the steel tube;

applying molten zinc to the cleaned surface by pouring the molten zinc from a molten zinc supply onto the steel sheet at intervals extending along the path;

supporting the steel sheet at the position along the path where the molten zinc is poured onto the steel sheet to prevent the steel sheet from sagging and to form a substantially uniform coating of zinc on the steel sheet;

directing streams of air from beneath the steel sheet upwardly toward the edges of the steel sheet to prevent the molten zinc from flowing from the top surface of the steel sheet onto the bottom surface of the steel sheet;

cooling the steel sheet to harden the zinc coating;

forming the steel sheet into a cylindrical tube; and welding the edges of the steel sheet together to form a longitudinal seam in the tube.

4. The method of manufacturing steel tubes from steel sheet as described in claim 3 and wherein the step of cleaning at least the surface of the steel sheet that corresponds to the inside of the steel tube comprises shot blasting the steel sheet.

5. The method of manufacturing steel tubes from steel sheet as described in claim 3 and further including the steps of:

cleaning the exterior of the formed steel tube;

applying molten metal to the exterior of the steel tube;

cooling the steel tube; and cutting the steel tube to length.

6. The method of manufacturing steel tube from steel sheet as described in claim 5 and wherein the step of applying molten metal to the exterior of the steel tube comprises spraying with gas the molten metal over the surface of the steel tube.

7. The method of manufacturing steel tube from steel sheet as described in claim 3 and wherein the step of advancing the elongated strip of steel sheet along its length comprises advancing the steel sheet at the rate of between 30 and 180 meters per minute.

* * * * *